United States Patent [19]

Iwata et al.

[11] Patent Number: 4,561,829

[45] Date of Patent: Dec. 31, 1985

[54] ROTARY COMPRESSOR WITH TAPERED VALVE PORTS FOR LUBRICATING PUMP

[75] Inventors: Hiroshi Iwata, Odawara; Masahiro Takebayashi; Akio Sakazume, both of Yokohama; Yoshihisa Uneyama, Tochigi; Kazuo Sekigami, Tochigi; Shigetaro Tagawa, Tochigi; Masahiko Sugiyama, Tochigi, all of Japan

[73] Assignee: Hitachi, Ltd., Tokyo, Japan

[21] Appl. No.: 576,337

[22] Filed: Feb. 2, 1984

[30] Foreign Application Priority Data

Mar. 10, 1983 [JP] Japan ..... 58-38340

[51] Int. Cl.[4] ..... F04B 39/02; F04C 18/00; F04C 29/02

[52] U.S. Cl. ..... 417/368; 417/410; 417/490; 417/557; 417/902; 418/63; 418/88; 418/94; 184/6.16

[58] Field of Search ..... 417/204, 240, 241, 368, 417/372, 557, 410, 902, 490; 418/63, 87, 88, 94; 184/6.16

[56] References Cited

U.S. PATENT DOCUMENTS

| | | | |
|---|---|---|---|
| 1,180,613 | 4/1916 | Siemen | 417/68 |
| 2,422,972 | 6/1947 | Knowles | 418/66 |
| 2,819,678 | 1/1958 | Nordell et al. | 417/520 |
| 3,897,173 | 7/1975 | Mardroian | 417/240 X |
| 4,385,875 | 5/1983 | Kanazawa | 418/88 |

FOREIGN PATENT DOCUMENTS

| | | | |
|---|---|---|---|
| 31918 | 3/1979 | Japan | 418/63 |
| 20795 | 2/1981 | Japan | 418/88 |
| 168084 | 10/1982 | Japan | 418/88 |
| 303953 | 1/1929 | United Kingdom | 417/490 |
| 699233 | 11/1979 | U.S.S.R. | 417/241 |

*Primary Examiner*—William L. Freeh
*Assistant Examiner*—Paul F. Neils
*Attorney, Agent, or Firm*—Antonelli, Terry & Wands

[57] ABSTRACT

A horizontal compressor including an electric motor and a compressor element mounted in a case serving concurrently as an oil sump. The compressor element includes a cylinder, a shaft having a crank, a roller fitted to the crank for eccentric rotation along inner side surfaces of the cylinder, a vane moving in reciprocatory movement in a bore of the cylinder while abutting against the roller, two side plates located on opposite sides of the cylinder, one of the two side plates being formed with a suction port for a lubricant and the other side plate being formed with a discharge port for the lubricant, and a pump chamber defined by a back of the vane, the bore of the cylinder and the two side plates. The suction port is in the form of a tapering port including a small diameter portion directly adjacent the pump chamber and a large diameter portion directly adjacent the case; the discharge port is in the form of a tapering port including a small diameter portion directly adjacent the lubricant feed passage and a large diameter portion directly adjacent the pump chamber; and a space is provided at least to the suction port in a position in which the space is in communication with the small diameter portion of the suction port.

1 Claim, 8 Drawing Figures

ROTARY COMPRESSOR WITH TAPERED VALVE PORTS FOR LUBRICATING PUMP

FIELD OF THE INVENTION

This invention relates to horizontal compressors suitable for use with refrigeration apparatus and air-conditioning systems, and more particularly it is concerned with a horizontal compressor capable of ensuring that a lubricant is fed in sufficient volume.

DESCRIPTION OF THE PRIOR ART

Figure 1:
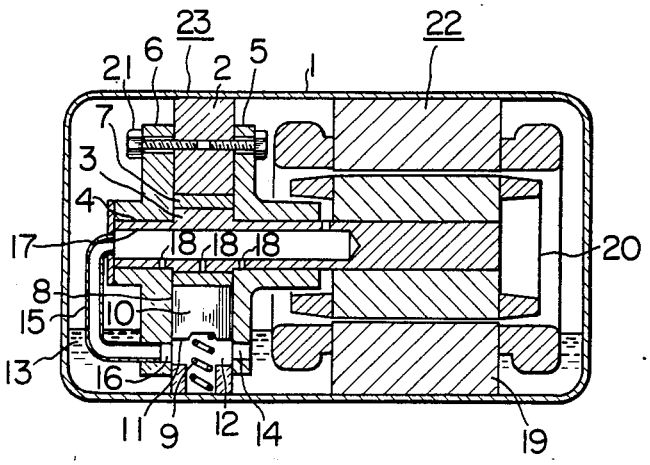
FIG. 1 PRIOR ART
FIG. 1 is a vertical sectional view of a horizontal compressor, showing one example of the prior art.

One example of the conventional horizontal compressor will be described by referring to FIG. 1. In FIG. 1, the reference numeral 1 designates a case, which doubles as an oil sump, and an electric motor 22 and a compressor element 23 are received therein.

The electric motor 22 comprises a stator 19 and a rotor 20. A shaft 4 having a crank 3 and hollow 17 drilled at one end portion thereof is fitted in the rotor 20.

The compressor element 23 comprises a cylinder 2, the shaft 4, side plates 5 and 6 located on opposite sides of the cylinder 2 which concurrently serve as bearings for the shaft 4 and side walls for the cylinder 2, bolts 21 connecting the side plates 5 and 6 and the cylinder 2 together, a roller 7 fitted to the crank 3 for eccentric rotation along inner side surfaces of the cylinder 2, a vane 10 moving in reciprocatory movement in a bore 8 of the cylinder 2 while abutting against the roller 7 and having a forward end in contact with the roller 7 rotating with the rotation of the crank 3 and an opposite end urged by the biasing force of a spring 9 to move in reciprocatory movement in the bore 8 of the cylinder 2, and a pump chamber 12 defined by a back 11 of the vane 10, the bore 8 of the cylinder 2 and the side plates 5 and 6. The side plate 5 is formed with a suction port 14 for drawing by suction a lubricant 13 from the case 1 into the pump chamber 12, and the side plate 6 is formed with a discharge port 16 for discharging the lubricant from the pump chamber 12 into a lubricant feed line 15. The lubricant is fed into the hollow 17 formed in one end portion of the shaft 4 by way of the lubricant feed line 15. From the hollow 17 the lubricant 13 is fed through ports 18 to portions requiring lubrication.

In the horizontal compressor of the aforesaid construction, the vane 10 is urged by the biasing force of the spring 9 to move in reciprocatory movement in the bore 8 of the cylinder 2 while its forward end is abutted against the roller 7, as the horizontal compressor is driven and the roller 7 rotates together with the shaft 4. As a result, a refrigerant flowing through a refrigerant inlet port, (not shown) into the compressor is discharged therefrom through a refrigerant outlet port. (not shown).

Meanwhile, the reciprocatory movement of the vane 10 causes a change of the volume of the pump chamber 12, enabling pumping to be performed. More specifically, when the pump chamber 12 increases in volume, the lubricant 13 is drawn by suction through the suction port 14 into the pump chamber 12; when the pump chamber 12 decreases in volume, the lubricant 13 is discharged from the pump chamber 12 through the lubricant feed line 15 and supplied through the hollow 17 and ports 18 into the portions requiring lubrication.

Some disadvantages are associated with the horizontal compressor of the aforesaid construction and operation.

More specifically, the lubricant 13 is drawn by suction from the case 1 through the suction port 14 into the pump chamber 12, as described hereinabove. At this time, the lubricant in the lubricant feed line 15 is also drawn by suction into the pump chamber 12. This would causes the lubricant in the lubricant feed line 15 to flow backwardly. Also, when the pump chamber 12 decreases in volume, the lubricant is discharged through the discharge port 16 into the lubricant feed line 15. At the same time, the lubricant is discharged also into the case 1 through the suction port 14, and this would also cause the lubricant to flow backwardly.

Particularly, the resistance offered to the flow of the lubricant would be great on the side of the discharge port 16 because of the resistance offered by the lubricant feed line 15 and a head required for the lubricant to flow to the center axis of the shaft 4, so that the lubricant would tend to flow backwardly toward the suction port and might fail to reach the center axis of the shaft 4. Thus, difficulties are faced in ensuring that the lubricant is fed to the hollow 17 in sufficient volume.

SUMMARY OF THE INVENTION

This invention has been developed for the purpose of obviating the aforesaid disadvantages of the prior art. Accordingly, the object of the invention is to provide a horizontal compressor capable of supplying sufficient lubricant to the portions which require the lubrication.

According to the invention, there is provided a horizontal compressor comprising an electric motor and a compressor element mounted in a case concurrently serving as an oil sump, such compressor element comprising a cylinder, a shaft having a crank, a roller fitted to the crank for eccentric rotation along inner side surfaces of the cylinder, a vane moving in reciprocatory movement in a bore of the cylinder while abutting against the roller, two side plates located on opposite sides of the cylinder, one of the side plates being formed with a suction port for a lubricant and the other side plate being formed with a discharge port for the lubricant, and a pump chamber defined by a back of the vane, the bore of the cylinder and the two side plates. A pumping action according to the reciprocatory movement of the vane following the rotation of the shaft introduces a lubricant under pressure from the case through the suction port into the pump chamber and feeds the lubricant under pressure through the discharge port into one end portion of the shaft through a lubricant feed passage. The improvement resides in that the suction port is in the form of a tapering port including a small diameter portion directly adjacent the pump chamber and a large diameter portion directly adjacent the case, and the discharge port is in the form of a tapering port including a small diameter portion directly adjacent the lubricant feed passage and a large diameter portion directly adjacent the pump chamber, and a space is provided at least to the suction port in a position in which the space is in communication with the small diameter portion of the suction port.

An added feature is that the small diameter portion of the suction port in the form of a tapering port is smaller in cross-sectional area than the small diameter portion of the discharge port in the form of a tapering port. By virtue of this feature, the compressor has a valving function which reduces the resistance to the flow of the lubricant in a normal direction (from the large diameter portion toward the small diameter portion) and increases the resistance to the flow of the lubricant in a reverse direction (from the small diameter portion toward the large diameter portion).

These and other objects, features and advantages of the present invention will become more apparent from the following description when taken in connection with the accompanying drawings, particularly FIGS. 2–8, which show, for purposes of illustration only, one embodiment in accordance with the invention.

DESCRIPTION OF THE PREFERRED EMBODIMENT

Figure 2:
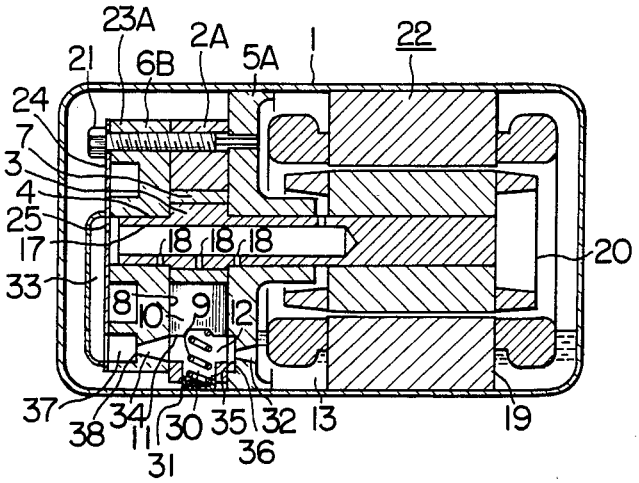
FIG. 2 is a vertical sectional view of the horizontal compressor comprising one embodiment of the invention.

Referring now to the drawings, particularly FIG. 2, it is noted that parts similar to those shown in FIG. 1 are designated by like reference characters. The horizontal compressor in FIG. 2 is one embodiment of the invention and comprises a case 1 concurrently serving as an oil sump, an electric motor 22 and a compressor element 23A mounted in the case 1. The compressor element 23A comprises a cylinder 2A, a shaft 4 having a crank 3, a roller 7 fitted to the crank 3 for eccentric rotation along inner side surfaces of the cylinder 2A, a vane 10 moving in reciprocatory movement in bore 8 of the cylinder 2A while abutting against the roller 7, a side plate 5A located on one side of the cylinder 2A and being formed with a suction portion 32 (to be subsequently described in detail) in the form of a tapering port formed with a space 35 contiguous with a small diameter portion of the tapering port, a side plate 6B located on the other side of the cylinder 2A and being formed with a discharge port 34 (to be subsequently described in detail) in the form of a tapering port formed with a space 37 contiguous with a small diameter portion of the tapering port, a side plate cover 24 secured to one side of the side plate 6B and formed in a central portion with a port 25 opening in a hollow 17 formed in the shaft 4, a lubricant feed passge 33 maintaining the space 37 in communication with the port 25 of the side plate cover 24 for supplying the lubricant discharged through the discharge port 34 to the hollow 17, and a pump chamber 12 defined by a back 11 of the vane 10, the bore 8 of the cylinder 2A, side plates 5A and 6B and a seal member 31 located at a lower end of a spring mounting hole 30.

Figure 3:
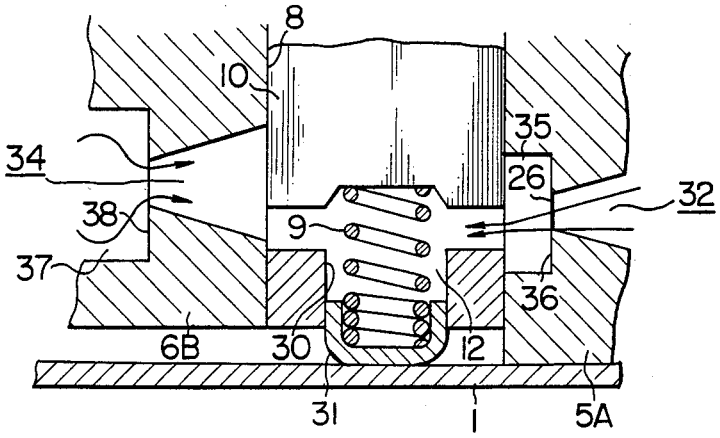
FIG. 3 is an enlarged vertical sectional view of the portions in the vicinity of the pump chamber shown in FIG. 2, showing the flow of a lubricant as the volume of the pump chamber increases.

The suction port 32 and discharge port 34 will be described in detail by referring to FIG. 3. The suction port 32 is in the form of a tapering port including a small diameter portion directly adjacent the pump chamber 12 and opening therein, and a large diameter portion directly adjacent the case 1 and opening therein. The space 35 is connected to the small diameter portion. Meanwhile, the discharge port 34 is also in the form of a tapering port including a small diameter portion directly adjacent the lubricant feed passage 33 and opening therein, and a large diameter portion directly adjacent the pump chamber 12 and opening therein. The space 37 is connected to the small diameter portion. The small diameter portion of the suction port 32 is smaller in diameter than the small diameter portion of the discharge port 34.

Operation of the horizontal compressor according to the invention constructed as aforesaid will be described. When the motor 22 is actuated to drive the shaft 4 for rotation, the roller 7 rotates together with the shaft 4. This causes the vane 10 urged by the biasing force of a spring 9 to move in reciprocatory movement in the bore 8 of the cylinder 2A while its forward end is abutting against the roller 7. Thus, a refrigerant flowing into the cylinder 2A through a refrigerant inlet port (not shown) is compressed and discharged to outside through a refrigerant discharge port (not shown).

As the pump chamber 12 has its volume increased by the reciprocatory movement of the vane 10, the lubricant in the case 1 is drawn by suction into the pump chamber 12 from the case 1 as indicated by arrows in FIG. 2. At this time, the lubricant is also drawn through the discharge port 34. However, the flow of lubricant expanded in the space 37 is contracted by an end face 38 defining an entrance to the small diameter portion of the discharge port 34, so that a resistance of high magnitude is offered to the flow of the lubricant. This phenomenon is referred to as an edge effect. Thus, the backflow of the lubricant through the discharge port 34 into the pump chamber 12 is greatly lessened than would be the case if no space 37 were provided to the discharge port 34 of the tapering port, and the lubricant led into the pump chamber 12 is almost all introduced through the suction port 32.

Figure 4:
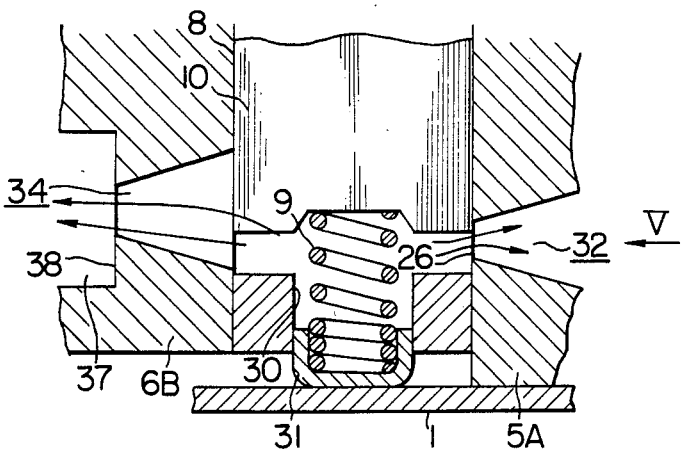
FIG. 4 is an enlarged vertical sectional view of the portions in the vicinity of the pump chamber shown in FIG. 2, obtained by assuming that no additional space is provided to the suction port and showing the flow of the lubricant as it is discharged while the volume of the pump chamber decreases.
Figure 5:
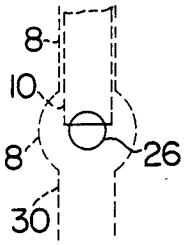
FIG. 5 is a view as seen in the direction of an arrow V in FIG. 4.

As the vane 10 moves downwardly to reduce the volume of the pump chamber 12, the lubricant is discharged through the discharge port 34 into the lubricant feed passage 33. At this time, the lubricant is also discharged through the suction port 32 into the case 1. In this case, if no space were provided adjacent the small diameter portion of the suction port 32 of the tapering port as shown in FIGS. 4 and 5, a part of an entrance 26 to the small diameter portion of the suction port 32 of the tapering port would be blocked by the vane 10 and the lubricant would flow as indicated by arrows in FIG. 4, so that the edge effect would not function as desired. Meanwhile, in the invention, the space 35 is provided adjacent the small diameter portion of the suction port 32 of the tapering port. By virtue of this arrangement, the edge effect can be obtained because the flow of the lubricant is expanded in the space 35 before it is contracted at the entrance 26 to the small diameter portion of the suction port 32 of the tapering port due to the fact that the vane 10 and the entrance 26 are spaced apart from each other by a substantial distance, although the lower end portion of the vane 10 and the upper end of the entrance 26 slightly overlap. Thus, it is difficult for the lubricant to flow back. In addition, since the small diameter portion of the suction port 32 has a diameter smaller than that of the small diameter portion of the discharge port 34, the resistance offered to the flow of the lubricant from the pump chamber 12 to the case 1 through the suction port 32 is represented by that offered by the small diameter portion of the suction port 32 alone, and the smaller the diameter of the small diameter portion, the greater is the resistance offered to the flow of the lubricant. Meanwhile, when the lubricant flows back from the hollow 17 of the shaft 4 to the pump chamber 12, the resistance offered to the flow is not represented by the small diameter portion of the discharge port 34 alone but the resistance offered by the lubricant feed passage 33 and the head of the lubricant from the discharge port 34 to the hollow 17 of the shaft 4 are added to the resistance offered to the small diameter portion of the discharge port 34. Therefore, the feature that the small diameter portion of the suction port 32 is smaller in diameter than the small diameter portion of the discharge port 34 results in the resistance offered to the flow from the pump chamber 12 to the hollow 17 of the shaft 4 being less than the resistance offered to the backflow from the pump chamber 12 to the case 1. Consequently, almost all of the lubricant discharged from the pump chamber 12 is supplied to the lubricant feed passage 33 and fed into the portions requiring lubrication through the hollow 17 and ports 18.

In the embodiment of the invention described hereinabove, the suction port 32 and discharge port 34 each are formed in the form of a tapering port, and the small diameter portions of the tapering suction and discharge ports 32 and 34 are provided with the respective spaces 35 and 37. In addition, the small diameter portion of the suction port 32 of the tapering port has a diameter smaller than that of the small diameter portion of the discharge port 34 of the tapering port. By virtue of these features, the lubricant can be fed in sufficient volume and with stability to those portions which require lubrication.

Figure 6:
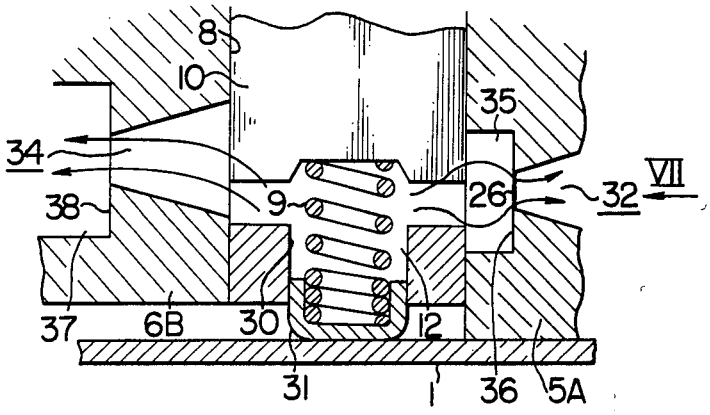
FIG. 6 is an enlarged vertical sectional view of the portions in the vicinity of the pump chamber shown in FIG. 2, showing the flow of the lubricant as it is discharged while the volume of the pump chamber decreases.
Figure 7:
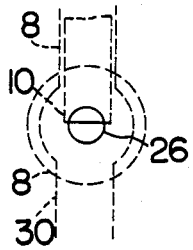
FIG. 7 is a view as seen in the direction of an arrow VII in FIG. 6.
Figure 8:
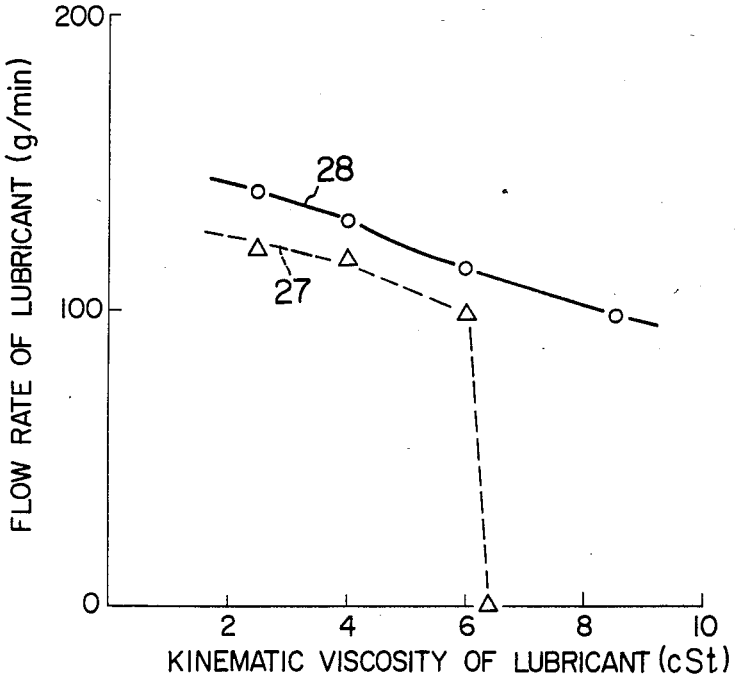
FIG. 8 is a diagrammatic representation of the lubricant flowrate-dynamic viscosity characteristic of the horizontal compressor according to the invention, shown as one example of the influences exerted by the presence of an additional space in the suction port.

The effect achieved by the presence of the space 35 with respect to variations in the dynamic viscosity of the lubricant (which are changed by operation conditions) will be described by referring to a graph shown in FIG. 8 in which a broken line 27 represents the volume of lubricant obtained by a compressor having no space 35 in the vicinity of the pump chamber 12 as shown in FIG. 4, and a solid line 28 indicates the volume of lubricant obtained by a compressor having the space 35 (of the embodiment) in the vicinity of the pump chamber as shown in FIG. 6. As can be clearly seen in FIG. 8, the volume of lubricant changes constantly when variations occur in the viscosity of the lubricant in the compressor provided with the space 35, and the volume of lubricant shows a sudden decline as the kinematic viscosity of the lubricant lincreases until the volume becomes almost zero in the compressor provided with no space 35. The reason why this phenomenon occurs is because the characteristic of the pumping action shown in FIG. 2 represents the characteristic of the pumping action utilizing the back 11 of the vane 10 plus the characteristic of the centrifugal pumping action utilizing the portion of the shaft 4. More specifically, if the lubricant is raised to a level equal to the height of the shaft 4 by the pumping action relying on the back 11 of the vane 10, then the lubricant is drawn by the centrifugal pumping action of the shaft 4, to enable feeding of the lubricant to be effected stably. If no space 35 is provided, the overall resistance offered to the flow of the lubricant to the height of the shaft 4 would increase and backflow would be ceased as the kinematic viscosity of the lubricant increases. Thus the lubricant might be prevented from rising to the level of the height of the shaft 4 in which case no centrifugal pumping action would be performed even if the shaft 4 rotates and the volume of the lubricant fed to the portions requiring lubrication would become substantially zero.

In the embodiment shown and described hereinabove, the suction port 32 and discharge port 34 have been described as being formed with the respective spaces 35 and 37 directly adjacent the small diameter portions. However, this is not restrictive, and only the suction port 32 may be formed with the space 35, although the provision of the two spaces 35 and 37 is conducive to improved pumping efficiency with an increase in the volume of lubricant fed to the portions requiring lubrication.

In the embodiment shown and described hereinabove, the suction and discharge ports 32 and 34 have been described as being circular in cross-sectional shape. However, this is not restrictive, and similar results can be achieved with suction and discharge ports of a rectangular cross-sectional shape, for example.

Also, in the embodiment shown and described hereinabove, the small diameter portion of the suction port 32 has been described as being smaller in diameter than the small diameter portion of the discharge port 34. However, this is not restrictive and the small diameter portions of the suction and discharge ports 32 and 34 may be of the same diameter. However, the difference in diameter between the small diameters of the suction and discharge ports 32 and 34 is conducive to improved pumping efficiency.

From the foregoing description, it will be appreciated that in the horizontal compressor according to the invention, it is possible to feed a sufficient volume of lubricant to portions which require lubrication.

What is claimed is:

1. A horizontal compressor comprising:

an electric motor, and a compressor element mounted in a case serving concurrently as an oil sump, said compressor element comprising:

a cylinder;

a shaft having a crank attached thereto;

a roller fitted to said crank for eccentric rotation along inner side surfaces of the cylinder;

a vane moving in reciprocatory movement in a bore of the cylinder while abutting against the roller;

two side plates located on opposite sides of the cylinder, one of said two side plates being formed with a suction port for a lubricant and the other side plate being formed with a discharge port for the lubricant; and a pump chamber defined by a back of the vane, the bore of the cylinder and the two side plates, and a pumping action according to the reciprocatory movement of said vane following the rotation of said shaft driven by the electric motor introducing a lubricant under pressure from the case through the suction port into the pump chamber and feeding the lubricant under pressure through the discharge port into one end portion of the shaft through a lubricant feed passage, wherein the improvement resides in that:

the suction port is in the form of a tapering port including a small diameter portion directly adjacent the pump chamber and a large diameter portion directly adjacent the case;

the discharge port is in the form of a tapering port including a small diameter portion directly adjacent the lubricant feed passage and a large diameter portion directly adjacent the pump chamber; and a space is provided at least to the suction port in a position in which the space is in communication with the small diameter portion of the suction port with said space opening directly into said pump chamber, and wherein the small diameter portion of the suction port is smaller in cross-sectional area than the small diameter portion of the discharge port.

* * * * *